US011756363B2

(12) United States Patent
Robinson et al.

(10) Patent No.: US 11,756,363 B2
(45) Date of Patent: Sep. 12, 2023

(54) SAFE CONDUIT DEVICE

(71) Applicant: Innovative Technology Limited, Oldham (GB)

(72) Inventors: John Robinson, Oldham (GB); Josh Sharland, Oldham (GB)

(73) Assignee: Innovative Technology Limited, Oldham (GB)

( * ) Notice: Subject to any disclaimer, the term of this patent is extended or adjusted under 35 U.S.C. 154(b) by 68 days.

(21) Appl. No.: 15/910,045

(22) Filed: Mar. 2, 2018

(65) Prior Publication Data

US 2018/0253925 A1 Sep. 6, 2018

(30) Foreign Application Priority Data

Mar. 6, 2017 (GB) ..... 1703543

(51) Int. Cl.

| | |
|---|---|
| ***G07D 11/40*** | (2019.01) |
| ***G07D 11/13*** | (2019.01) |
| ***G07D 11/18*** | (2019.01) |
| ***G07D 11/125*** | (2019.01) |
| ***B65H 31/00*** | (2006.01) |

(Continued)

(52) U.S. Cl.

CPC ..... *G07D 11/40* (2019.01); *B65H 31/00* (2013.01); *B65H 43/04* (2013.01); *G07D 7/00* (2013.01); *G07D 11/125* (2019.01); *G07D 11/13* (2019.01); *G07D 11/18* (2019.01); *B65H 2701/1912* (2013.01); *G07D 2207/00* (2013.01); *G07D 2211/00* (2013.01)

(58) Field of Classification Search

CPC ..... G07D 11/0039; G07D 11/0027; G07D 11/0078; G07D 11/0084; G07D 11/0036; G07D 11/0081; G07D 11/40; G07D 11/50; G07D 11/28; G07D 11/17; G07D 11/235; G07D 11/237; G07D 11/003; G07D 11/13; G07D 11/18; G07D 11/125; G07D 7/00; G07D 2207/00; G07D 2211/00; G07D 11/0096; B65H 31/00; B65H 43/04; B65H 2701/1912; E05G 1/02; E05G 1/024

USPC ..... 194/206, 207; 209/534; 235/379

See application file for complete search history.

(56) References Cited

U.S. PATENT DOCUMENTS

| | | | |
|---|---|---|---|
| 2,013,024 | A | 9/1935 | Bollinger |
| 5,653,436 | A | 8/1997 | Zouzoulas |

(Continued)

FOREIGN PATENT DOCUMENTS

| | | |
|---|---|---|
| CN | 101178820 | 5/2008 |
| CN | 10887605 | 11/2010 |

(Continued)

OTHER PUBLICATIONS

English Translation for DE202009016832U1 (Year: 2010).*

(Continued)

*Primary Examiner* — Jeffrey A Shapiro

(74) *Attorney, Agent, or Firm* — Woodard Emhardt Henry Reeves & Wagner LLP

(57) ABSTRACT

A safe conduit device having a banknote validator docking station, a banknote cashbox docking station spatially separated from the banknote validator docking station, and a banknote transport module configured to provide a removable bridge spanning the spatial separation between the banknote validator docking station and the banknote cashbox docking station.

14 Claims, 10 Drawing Sheets

(51) Int. Cl.
*B65H 43/04* (2006.01)
*G07D 7/00* (2016.01)

(56) References Cited

U.S. PATENT DOCUMENTS

| | | | | |
|---|---|---|---|---|
| 6,712,352 | B2 * | 3/2004 | Bergeron | G07D 11/13 271/181 |
| 9,483,893 | B2 * | 11/2016 | Bullock | G07D 11/125 |
| 9,582,972 | B2 * | 2/2017 | Tavares De Pinho | E05G 1/024 |
| 10,053,318 | B2 * | 8/2018 | Chou | B65H 31/22 |
| 2001/0015309 | A1 * | 8/2001 | Ikuta | B65H 29/40 194/206 |
| 2002/0056960 | A1 | 5/2002 | Bergeron et al. | |
| 2002/0066636 | A1 * | 6/2002 | Saltsov | G07D 11/40 194/302 |
| 2002/0074709 | A1 * | 6/2002 | Kanagawa | B65H 29/006 271/3.14 |
| 2002/0092727 | A1 * | 7/2002 | Kato | G07F 19/20 194/302 |
| 2003/0208970 | A1 * | 11/2003 | Saelzer | E06B 1/6084 52/167.1 |
| 2003/0230464 | A1 * | 12/2003 | Deaville | G07D 11/10 194/302 |
| 2005/0121286 | A1 * | 6/2005 | Lannello | G07F 17/3246 194/206 |
| 2008/0185259 | A1 * | 8/2008 | Deaville | G07F 19/205 194/204 |
| 2009/0107799 | A1 | 4/2009 | Kadowaki et al. | |
| 2009/0188973 | A1 * | 7/2009 | Coventry | G07F 19/20 235/379 |
| 2010/0307386 | A1 * | 12/2010 | Stockhausen | E04B 2/96 109/79 |
| 2011/0036681 | A1 * | 2/2011 | Dunlop | G07F 19/203 194/206 |
| 2011/0114441 | A1 | 5/2011 | Seki et al. | |
| 2013/0199422 | A1 * | 8/2013 | Starke | G07D 3/00 109/50 |
| 2013/0247799 | A1 * | 9/2013 | Furuichi | G07D 9/00 109/23 |
| 2014/0217669 | A1 * | 8/2014 | Aoji | B65H 31/22 271/297 |
| 2014/0300909 | A1 | 10/2014 | Robison | |
| 2015/0083792 | A1 * | 3/2015 | Bullock | G07D 11/125 232/1 D |
| 2015/0197977 | A1 * | 7/2015 | Baitz | E05G 1/06 271/207 |

FOREIGN PATENT DOCUMENTS

| | | | |
|---|---|---|---|
| CN | 1026440192 | 8/2012 | |
| CN | 103229216 | 7/2013 | |
| CN | 104871217 | 8/2015 | |
| DE | 202009016832 | 4/2010 | |
| DE | 202009016832 U1 * | 4/2010 | G07D 11/00 |

OTHER PUBLICATIONS

English Translation of DE 202009016832.
Search Report; GB Application No. GB 1703543.7, dated May 9, 2017.
CN2018101714026 Chinese Search Report dated Mar. 1, 2018.
EP18158022.6 EP Search Report dated Aug. 1, 2018.

* cited by examiner

SAFE CONDUIT DEVICE

REFERENCE TO RELATED APPLICATION

The present application claims the benefit of Great Britain Application No. GB1703543.7, Filed Mar. 6, 2017, which is hereby incorporated by reference.

BACKGROUND

The present invention generally relates to a banknote handling apparatus. More specifically, the present invention relates to a device for conveying banknotes from a banknote validator to a banknote cashbox located within a safe.

Typically, the safe is constructed from a robust, high strength material such steel or concrete in order that maximum protection is afforded to the one or more cashboxes housed within the safe. The thickness of the exterior wall of the safe is dependent upon safety requirements and the environment the banknote handling apparatus is to be operated within. Typically, the thickness of a conventional safe outer wall for a safe designed for this application is within the range of about 30 mm to 80 mm.

For a given safe wall thickness an intermediate transfer module is required to bridge the safe wall and thus enable the transportation of banknotes between the banknote validator located without the safe and the banknote cashbox located within the safe. Consequently, there is a disadvantage in that for each type of safe, i.e. for each safe wall thickness, a specifically sized intermediate transfer module must be employed to span the safe wall.

Another conventional arrangement is shown in FIG. 9A. Here, a banknote cashbox 64 is enclosed within a safe and is connected to a banknote validator 61. The safe is delimited by safe walls 66 and 67. The banknote validator 61 is housed within art upper compartment delimited by the safe walls 66, 67 and an upper wall 65.

Banknote ingress and egress is facilitated via an elongate validator bezel mouth 62 that extends through an opening disposed between safe wall 66 and upper wall 65.

If a banknote becomes jammed within the validator 61, or if some other routing maintenance is required, the banknote validator 61 can be detached from the banknote cashbox 64 in the direction of arrow 63 and removed from the upper compartment through the opening between safe wall 66 and upper wall 65.

However, a problem exists when the banknote validator 61 is removed as described above, in that access to the vulnerable upper portion of the banknote cashbox 64 is now possible, as shown by arrow 68, through the vacant opening. In this way unauthorised retrieval of banknotes from the cashbox 64 may be possible.

The present invention seeks to address the problems associated with the prior art as described above.

According to an aspect of the present invention there is provided a safe conduit device comprising: a banknote validator docking station; a banknote cashbox docking station spatially separated from said banknote validator docking station; and a banknote transport module configured to provide a removable bridge spanning the spatial separation between said banknote validator docking station and said banknote cashbox docking station.

Preferably, the banknote validator docking station is configured to removably receive and lockably engage with a banknote validator, and wherein the banknote cashbox docking station is configured to removably receive and lockably engage with a banknote cashbox.

Preferably, the banknote transport module includes a banknote transport path configured to enable the conveyance of a banknote between said banknote validator and said banknote cashbox.

Preferably, the banknote transport module comprises a plurality of drive rollers configured to engage with said banknote and transport it between said banknote validator and said banknote cashbox.

Preferably, the banknote transport module includes a first drive interface for engaging with a banknote validator first drive means, said first drive interface configured to transmit drive force from said banknote validator first drive means to said plurality of drive rollers.

Preferably, the banknote transport module includes a second drive interface for engaging with a banknote validator second drive means, said second drive interface configured to transmit drive force from said banknote validator second drive means to a banknote cashbox drive interface, said banknote cashbox drive interface configured to transmit drive force to a banknote cashbox stacker mechanism.

Preferably, the first drive interface comprises a first gear train, said first gear train arranged to mesh with a banknote validator first drive cog and a banknote cashbox first drive cog.

Preferably, each drive roller of the plurality of drive rollers is operatively interconnected with a respective cog of the first gear train.

Preferably, the second drive interface comprises a second gear train, said second gear train arranged to mesh with a banknote validator second drive cog and a banknote cashbox second drive cog.

Preferably, the banknote cashbox docking station includes mounting means for anchoring said banknote cashbox docking station to a support, and the support is the banknote validator docking station.

Alternatively, the support is a safe wall of a safe in which the safe conduit device has been installed.

In a preferred embodiment of the present invention, the safe wall delimits a boundary between the interior and the exterior of a safe to which the safe conduit device is attachable.

Preferably, the banknote transport module of the present invention is removable from said banknote validator docking station when the banknote validator is removed from said banknote validator docking station.

Typically, the spatial separation between the banknote validator docking station and the banknote cashbox docking station is greater than a width t of the wall.

In an alternative embodiment of the present invention, the support is an anchoring surface attached to, or extending from, a safe wall of a safe in which the safe conduit device has been installed.

An embodiment of the present invention will now be described, by way of example only, and with reference to the accompanying schematic drawings, in which:

DETAILED DESCRIPTION

Figure 1:
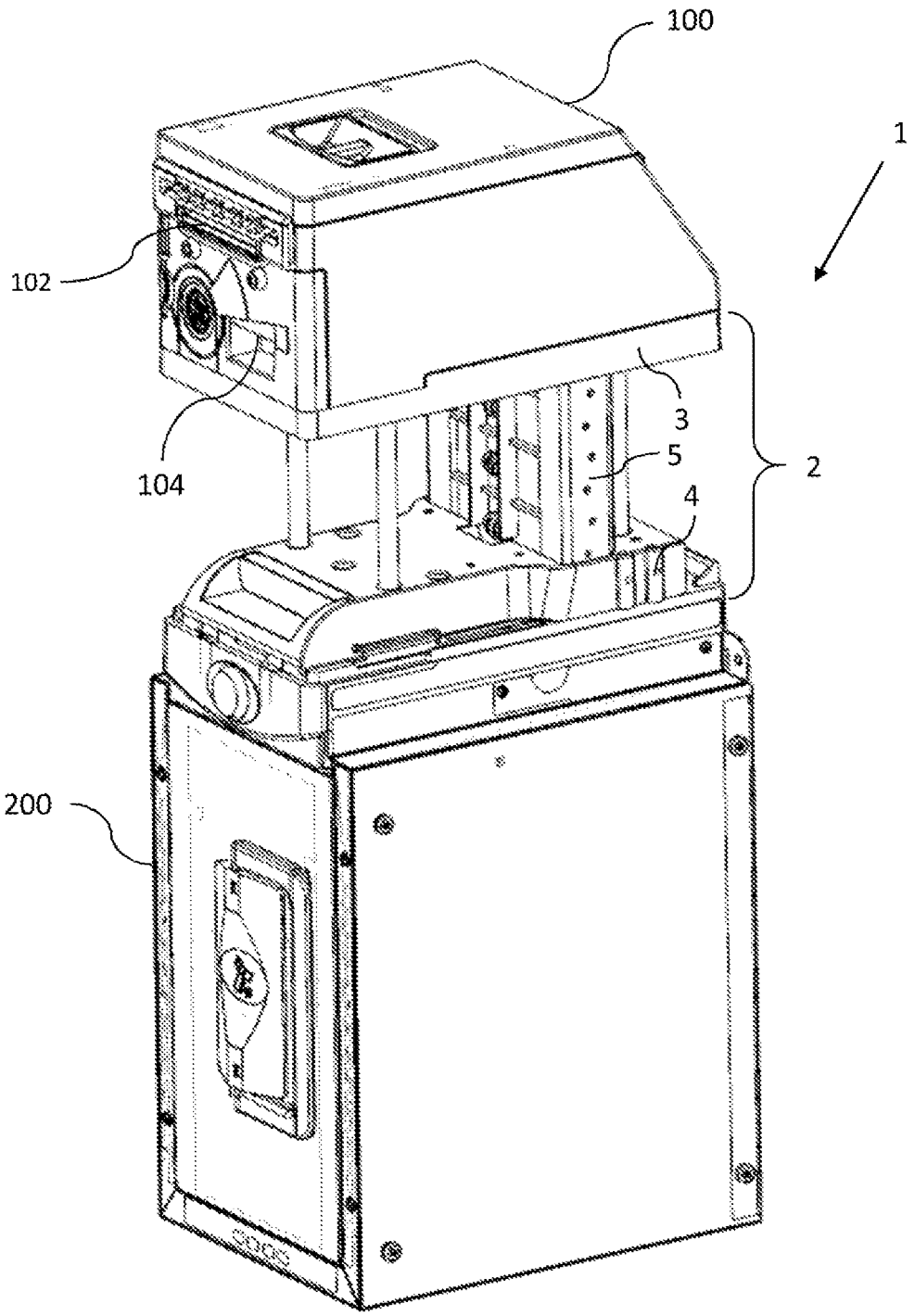
FIG. 1 shows a banknote handling apparatus according to the present invention.

With reference to FIG. 1, an embodiment of a banknote handling apparatus 1 according to the present invention comprises a banknote validator 100 interconnected to a banknote cashbox 200 via a safe conduit device 2.

Figure 2A:
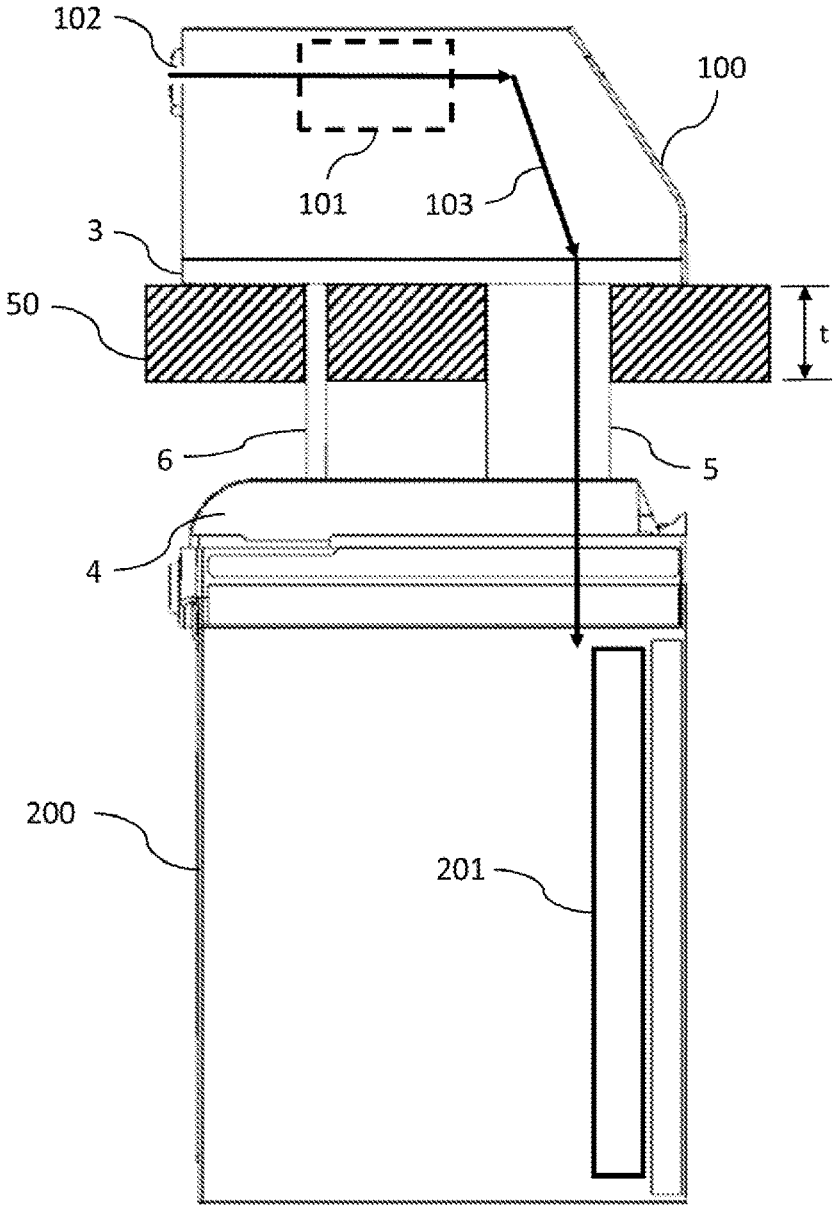
FIG. 2A is side elevation partial cross-sectional view of a banknote handling apparatus in situ within a safe.

FIG. 2A shows a banknote handling apparatus in use with a safe. For clarity, FIG. 2A shows only a partial cross-sectional view of a safe wall 50. The safe conduit device 2 comprises a banknote validator docking station 3 which is located on, and supported by, the safe wall 50. It should be noted that the safe wall 50 shown in FIG. 2A forms part of an upper, outer wall of a typical safe as will be familiar to someone skilled in the art. The safe conduit device 2 further includes a banknote cashbox docking station 4 and a banknote transport module 5 that interconnects the banknote validator docking station 3 and the banknote cashbox docking station 4. The cashbox docking station 4 depends from the banknote validator docking station 3 via one or more support members 6.

Figure 2B:
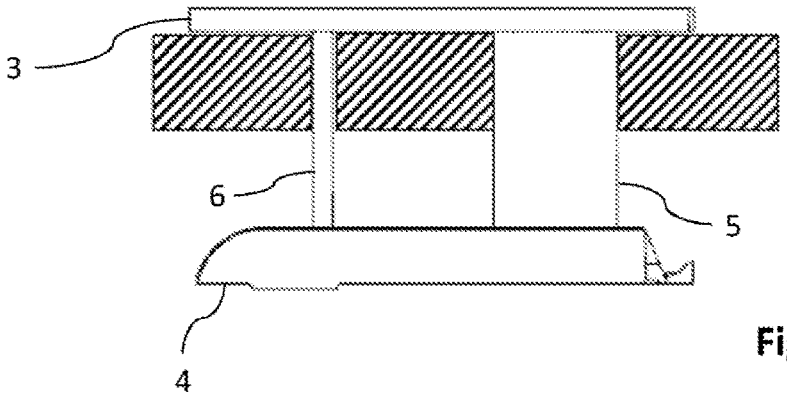
FIG. 2B is side elevation view of a safe conduit device according to the present invention.
Figure 3A:
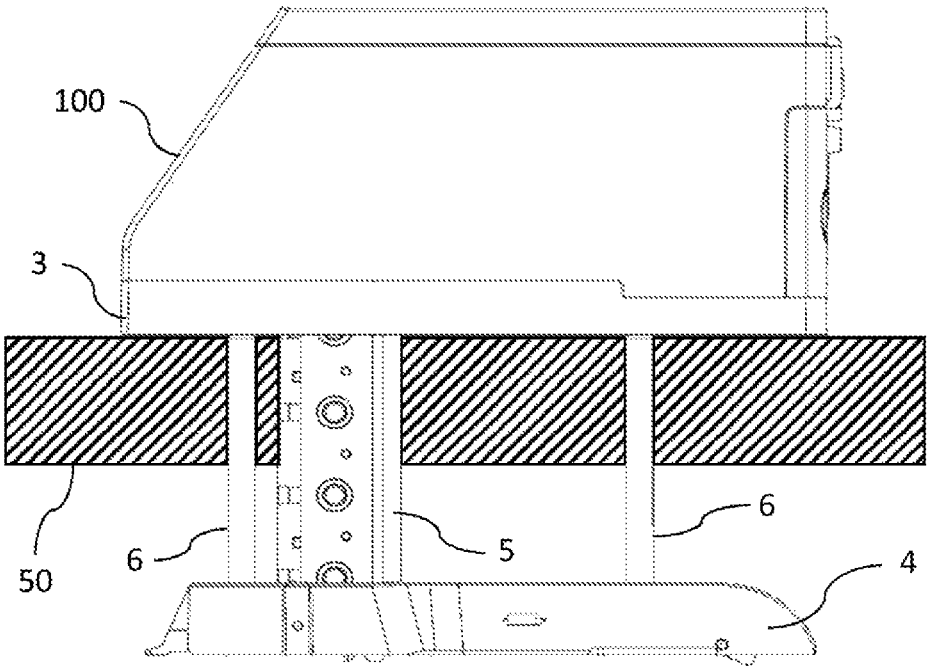
FIG. 3A is a side elevation view of a safe conduit device connected to a banknote validator.

As shown in FIGS. 2B and 3A, support members 6 pass through the safe wall 50 and are anchored above and below to the banknote validator docking station 3 and banknote cashbox docking station 4 respectively. Typically, the length of the support member and, in practice there will be more than one (see FIG. 3A) will be in a range between 3 cm and 8 cm to accommodate various safe wall thicknesses. The length of the banknote transport module 5 will also be fixed, but this will be longer than the length of the support member 6 in order that it can interface with both the banknote validator docking station 3 and the banknote cashbox docking station 4.

With reference to FIGS. 1 and 2A, the banknote validator 100, which is configured to securely mate and dock with the banknote validator docking station 3, includes a banknote input aperture 102. The banknote input aperture 102 is in operative communication with a banknote transport path 103 which traverses a banknote authentication module 101 and leads, via the banknote transport module 5, to a stacker mechanism 201 located within the banknote cashbox 200.

In operation, a banknote introduced into the banknote validator 100 via the banknote input aperture 102 will be transported along the banknote transport path 103 to the banknote authentication module 101 where it's validity will be checked. Acceptable banknotes will be passed through the banknote validator to the banknote cashbox 200 via the interconnecting banknote transport module 5. Once received in the banknote cashbox 200, acceptable notes will be placed onto a bundle of stored banknotes via a stacker mechanism 201. This process will be well known to a person skilled in the art and therefore no further explanation will be given here.

Figure 3B:
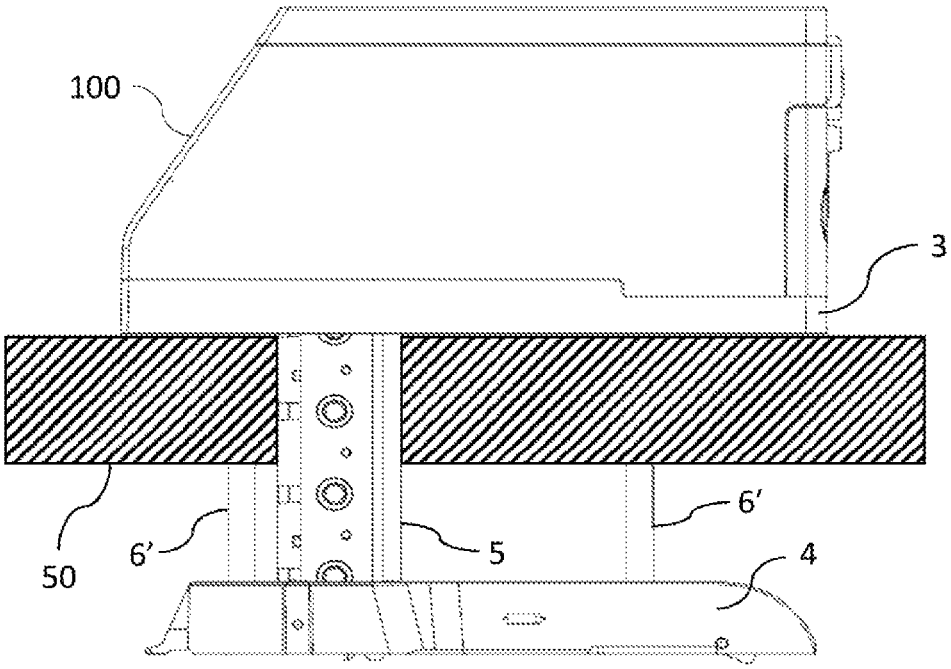
FIG. 3B is a side elevation view of a safe conduit device connected to a banknote validator with alternative support members.

As shown in FIG. 3B, an alternative embodiment of the present invention employs support members 6' that are shorter in length than those shown in FIG. 3A. Here, the support members 6' are anchored to the underside of the safe wall 50 rather than passing through to connect with the banknote validator docking station 3. This configuration may be used in situations where it is desirable to minimise the number of holes or apertures that are drilled through the safe wall before installation of the banknote handling apparatus 1.

Figure 3C:
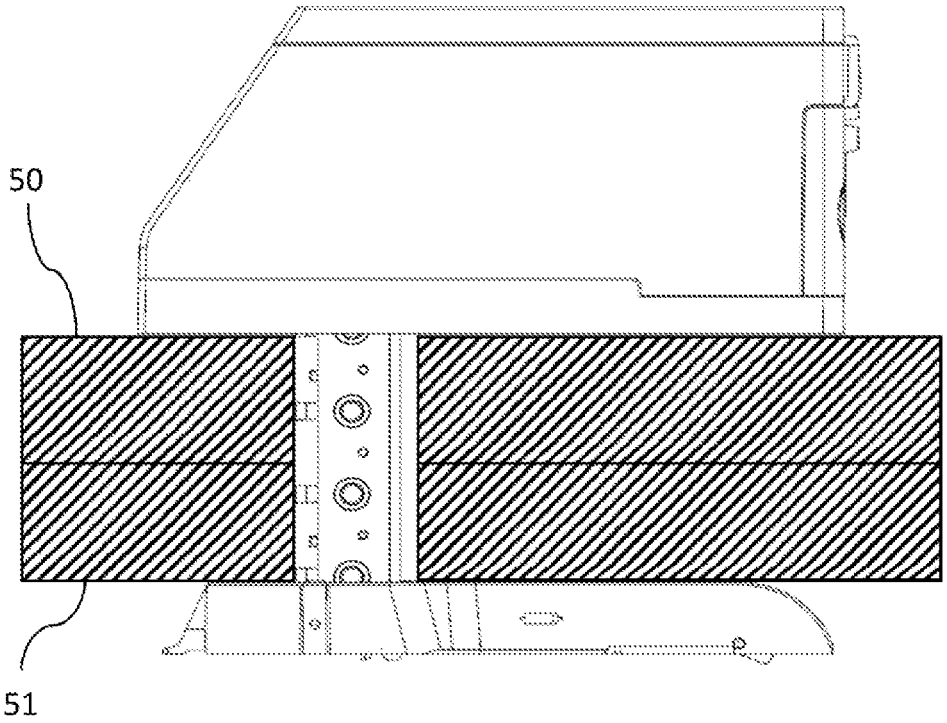
FIG. 3C is a side elevation view of a safe conduit device connected to a banknote validator in use in a safe with safe wall reinforcement.

Another alternative arrangement is shown in FIG. 3C. In this arrangement, no support members are required due to the presence of an additional intervening wall 51. Here, the upper surface of the banknote cashbox module 5 is directly anchored (by any suitable means) to the underside of the intervening wall 51. This configuration may be employed when, for example, it is desired that invasive drilling into the outer wall proximal to the banknote transport module 5 is minimised in order that reinforcement is maximised.

Figure 3D:
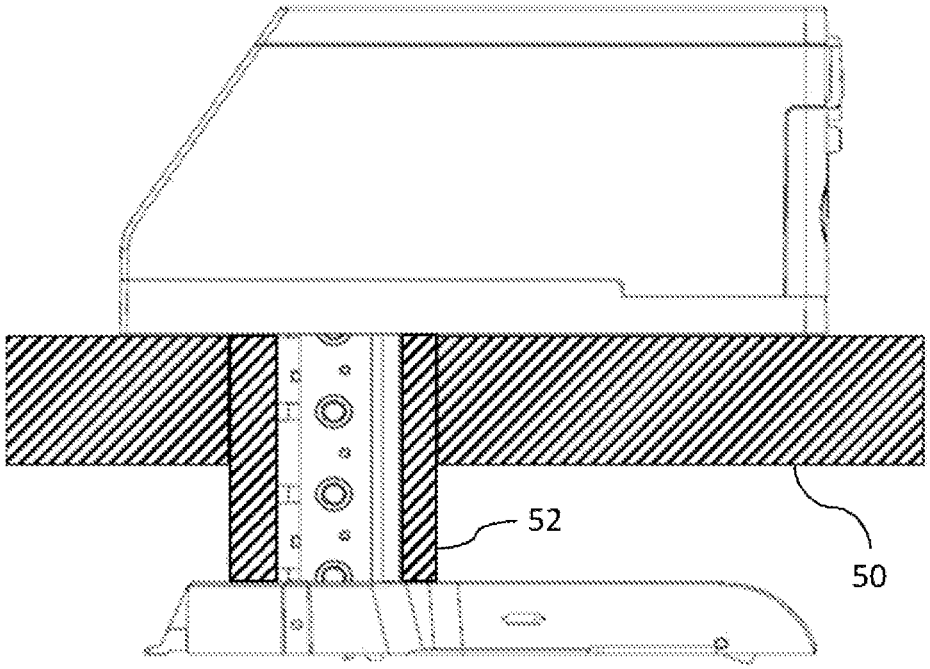
FIG. 3D is a side elevation view of a safe conduit device connected to a banknote validator in use in a safe having access aperture reinforcement.

In a further embodiment, as shown in FIG. 3D, a reinforcing sleeve 52 surrounds the banknote transport module 5. Again, no support members are required in this configuration, and the banknote cashbox docking station 4 is attached (via any suitable means) to an end of the reinforcing sleeve 52 that directly abuts the banknote cashbox docking station 4. The reinforcing sleeve 52 may be constructed from the same material from which the safe is fabricated, steel for example, or from any other suitable material as may be demanded by the given application.

Figure 4:
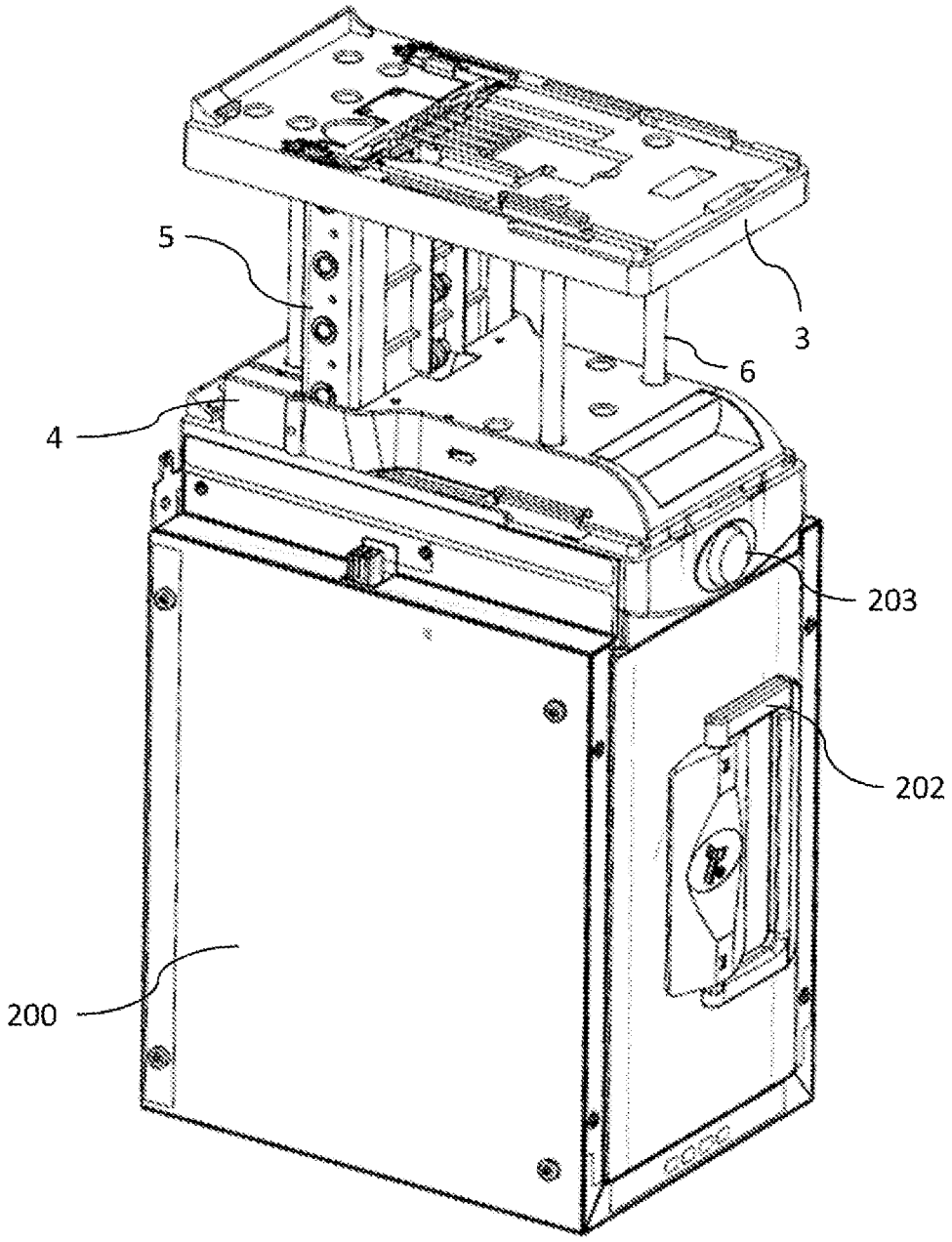
FIG. 4 is a perspective view of a safe conduit device according to the present invention connected to a banknote cashbox.
Figure 5:
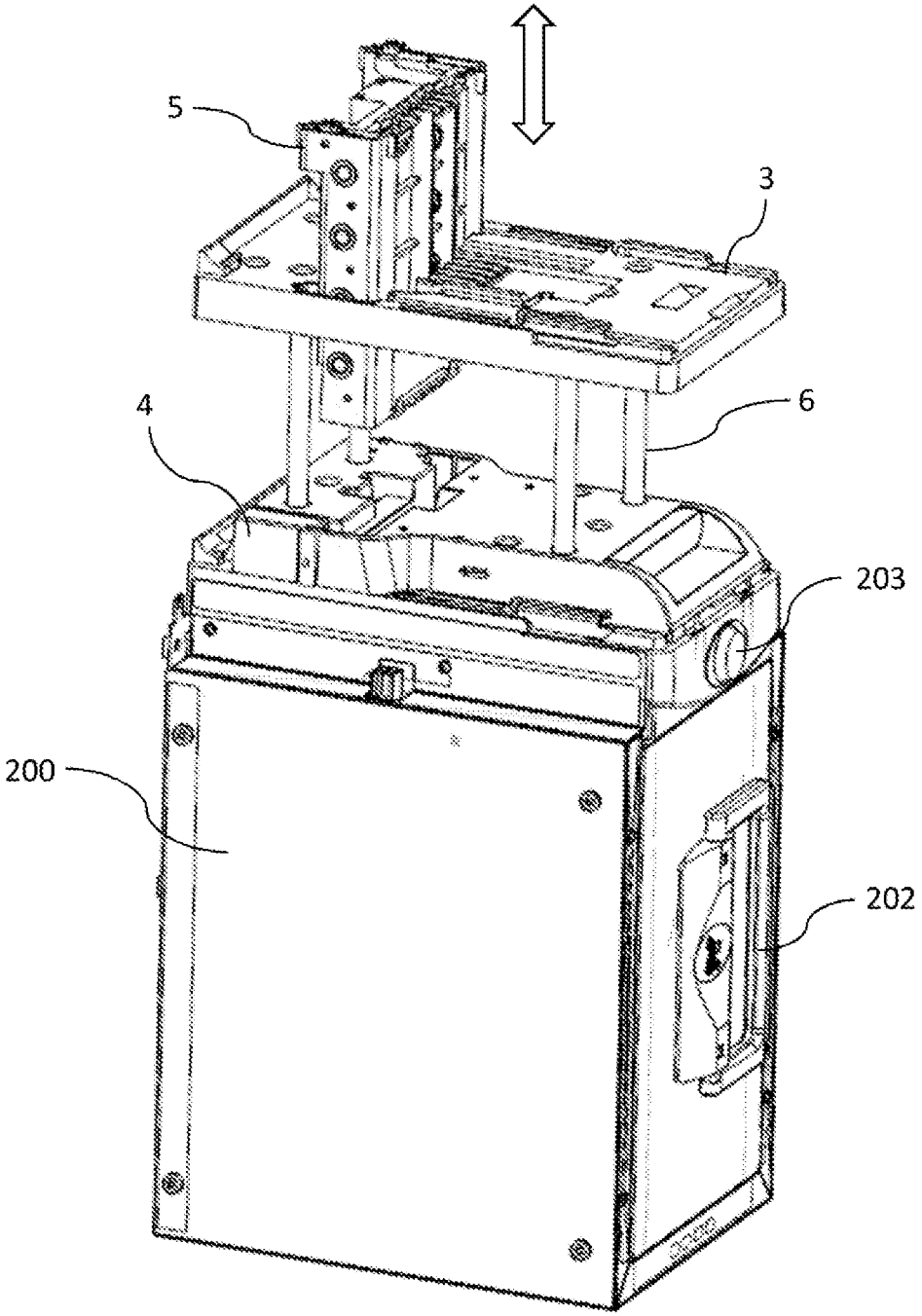
FIG. 5 is a perspective view of a safe conduit device according to the present invention connected to a banknote cashbox with a banknote transport module partially removed.
Figure 6:
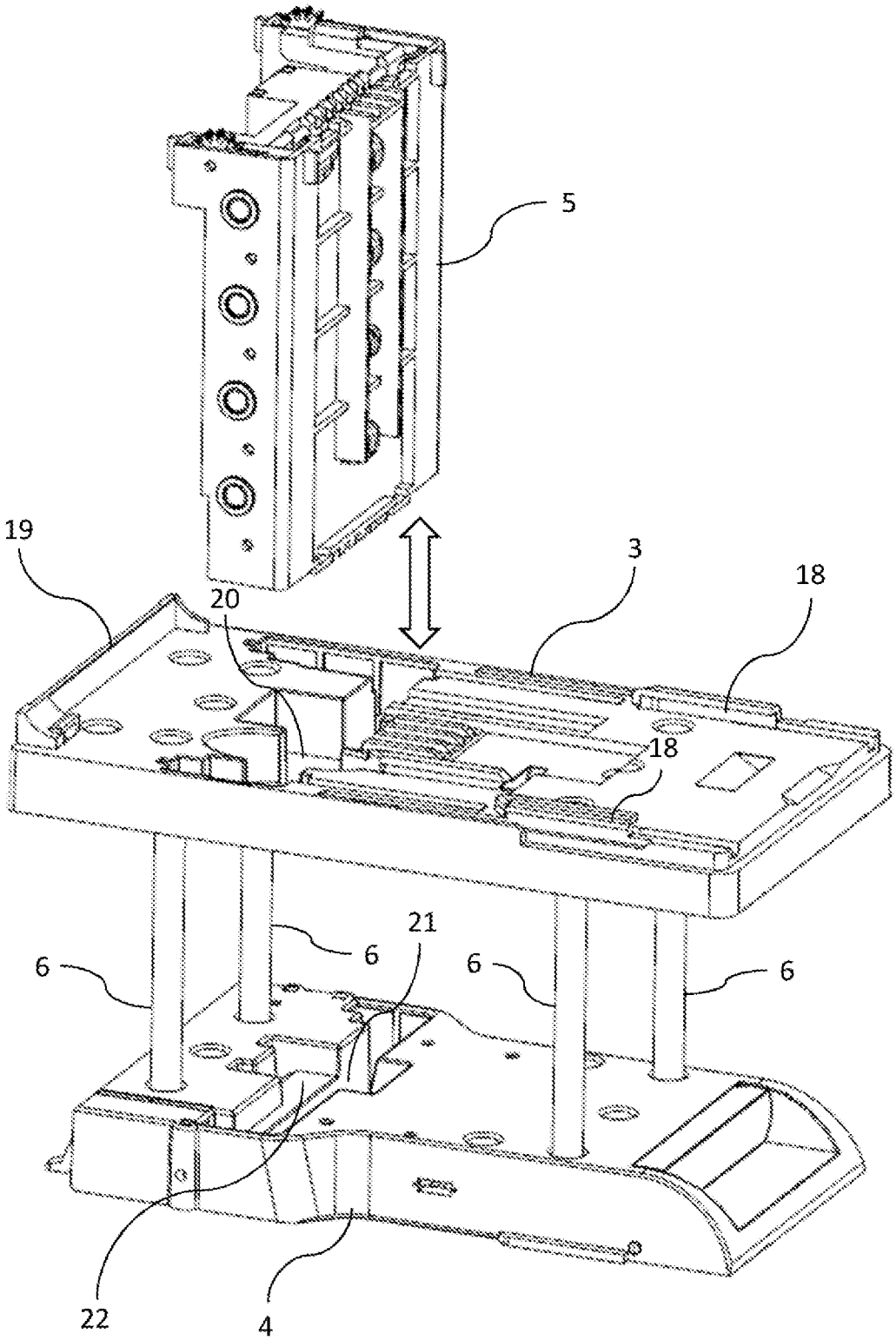
FIG. 6 is a perspective view of a safe conduit device with a fully removed banknote transport module.

With reference to FIGS. 4 to 6, the banknote transport module 5 can be removed from the safe conduit device when the banknote validator has been unlocked and released from engagement with the banknote validator docking station 3. In this way, if any banknote jamming event occurs within the banknote transport module 5, the mechanism can be accessed from without the safe by simply removing the banknote validator 100 and then removing the banknote transport module 5. Advantageously, no ingress to the safe itself is necessary to facilitate routine maintenance or remedial intervention when a banknote jamming event occurs.

The banknote cashbox 200 includes a cashbox handle 202 for assisting with the removal of the banknote cashbox 200 from the banknote cashbox docking station 4 when a cashbox release button 203 has been activated by an operative with authorisation to gain access to the interior of the safe.

As shown in FIG. 6, the banknote validator docking station 3 includes a pair of opposing banknote validator receiving lugs 18 and a rear raised abutment 19. During a banknote validator 100 installation operation, corresponding guide portions (not shown) disposed on the underside of a banknote validator are aligned and engaged with the receiving lugs 18 and the banknote validator is urged rearward until it abuts with the rear raised abutment 19, at this point the banknote validator becomes locked in place and can only be released via operation of ejector lever 104 (see FIG. 1).

The banknote validator docking station 3 includes an aperture 20 the shape of which mirrors and corresponds to the cross-sectional profile of the banknote transport module 5. In a similar manner, the banknote cashbox docking station 4 includes a receiving aperture 21 for receiving a proximal end of the banknote transport module 5. The receiving aperture 21 includes a stop lug 22 for aligning the ingress of the banknote transport module 5 during insertion and for delimiting the extent to which the banknote transport module 5 may travel in a downwards direction (as shown) during an insertion operation.

Figure 7:
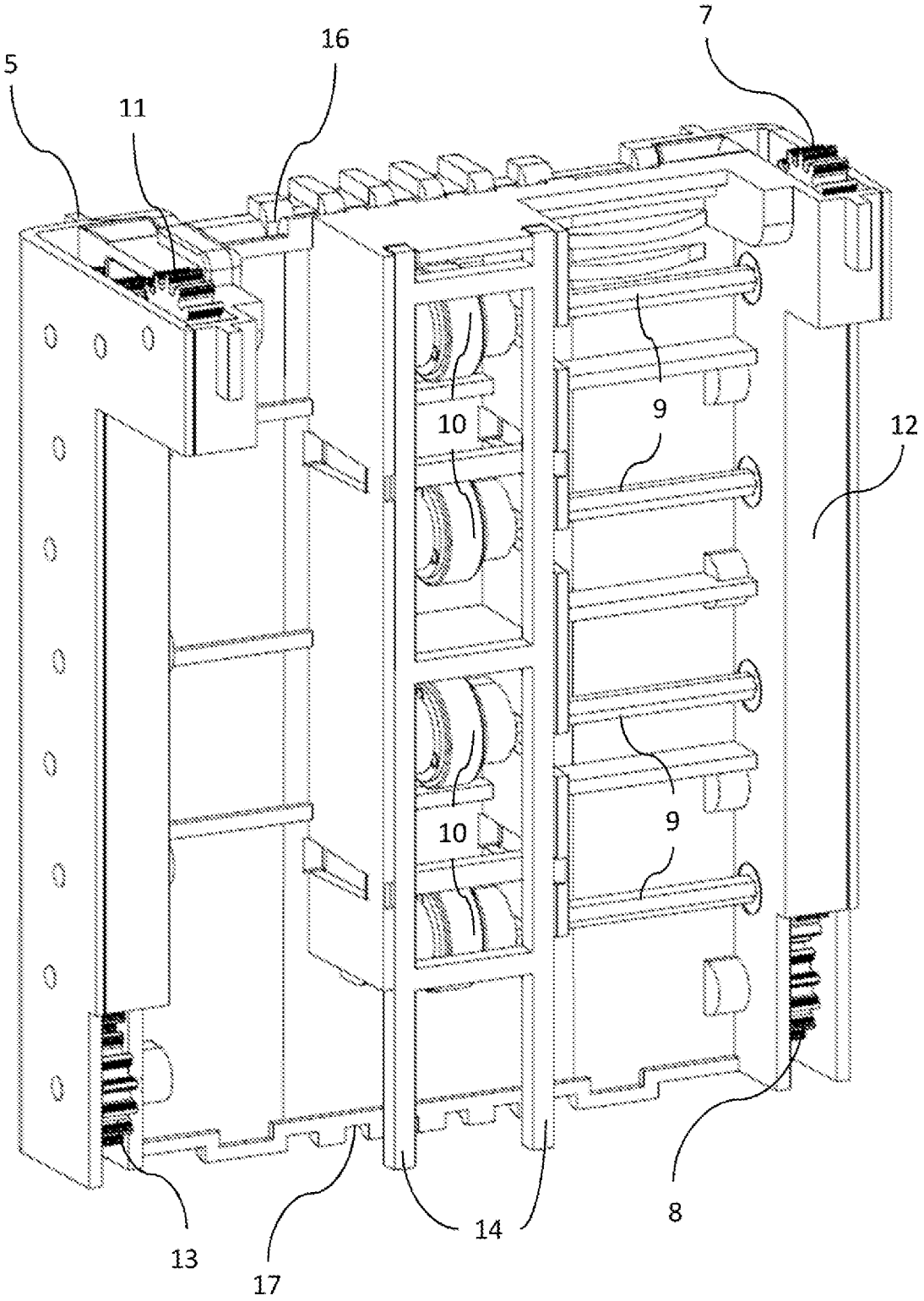
FIG. 7 is a rear perspective elevation view of the banknote transport module of the present invention.
Figure 8:
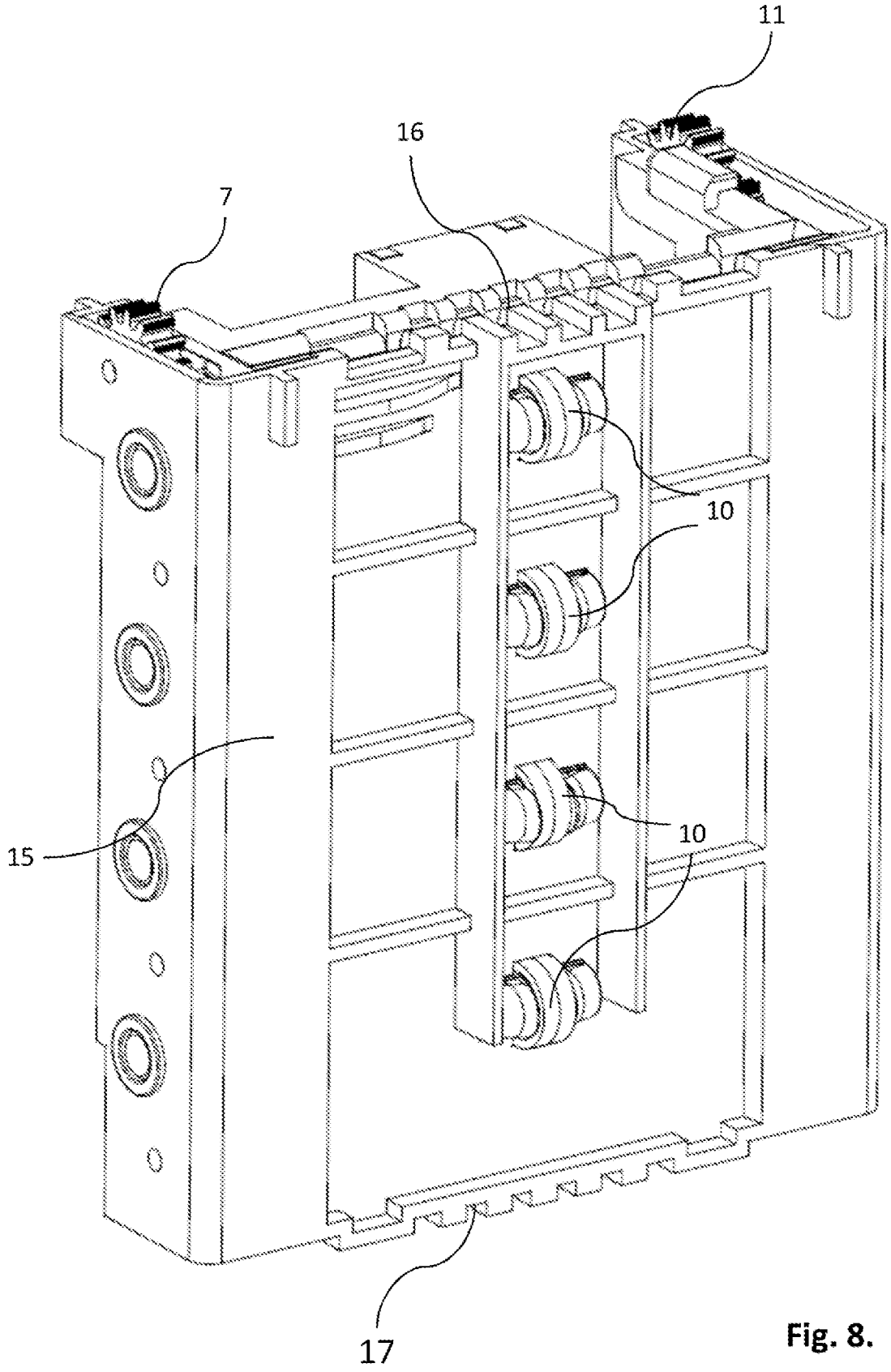
FIG. 8 is a front perspective elevation view of the banknote transport module of the present invention.
Figure 9A:
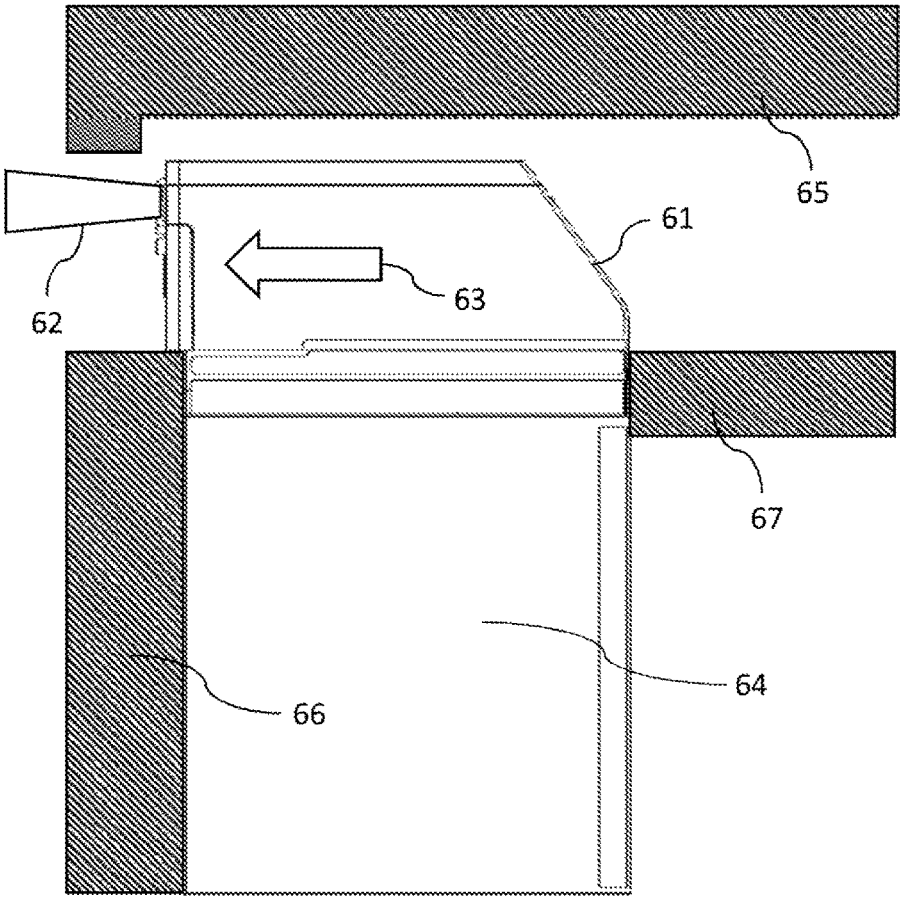
PRIOR ART Fig. 9A.
FIG. 9A shows a cross-sectional view of a prior art banknote apparatus housed within a safe.
Figure 9B:
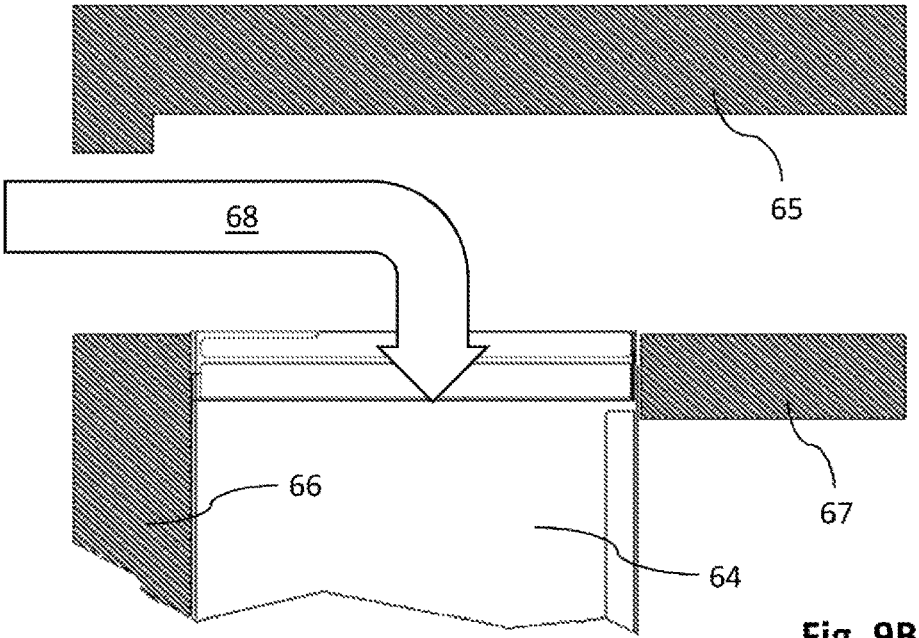
PRIOR ART Fig. 9B.
FIG. 9B shows the prior art banknote apparatus of FIG. 9A with the banknote validator removed.

The banknote transport module 5 will now be further described with reference to FIGS. 7 and 8.

The banknote transport module 5 comprises a generally hollow housing 12, a banknote ingress aperture 16, and a banknote egress aperture 17. Although not shown, the reader should be aware that a banknote transport passage connects the banknote ingress aperture 16 to the banknote egress aperture 17 to facilitate the passage of a banknote from the banknote validator 100 to the banknote cashbox 200. Furthermore, it should be understood that a banknote exit passage disposed on an underside of the banknote validator 100 aligns and communicates with the banknote ingress aperture 16 when the banknote validator is locked into place as described above.

A series of drive rollers 10 are arranged in line along a central portion of the banknote transport module 5. The drive rollers 10 partially impinge into the passageway interconnecting the banknote ingress aperture 16 and the banknote egress aperture 17, and each of the plurality of drive rollers 10 is connected, via a respective axle 9, with a corresponding gear of an internal drive gear train (not shown).

The banknote transport module 5 includes a motor drive interface cog 7 and a stacker drive interface cog 11. The motor drive interface cog 7 is interconnected with the internal drive gear train (not shown) and transmits a drive force from a banknote validator first drive means (not shown) to the series of drive rollers 10. In this way, banknotes can be transported through the banknote transport module 5 via operation of the banknote validator first drive means on the motor drive interface cog 7 which, in turn, transmits rotational drive to the drive rollers 10 via the axles 9. Drive force can also be transmitted to a banknote transport mechanism (not shown) housed within the banknote cashbox 200 via a further drive interface cog 8, the further drive interface cog 8 being arranged to operatively engage with a corresponding cashbox drive cog disposed on an upper surface of the banknote cashbox 200 (not shown). In this way, continuous banknote transportation is facilitated between the banknote validator 100, the banknote transport module 5, and the banknote cashbox 200. Advantageously, the continuous banknote transport is driven solely by the banknote validator first drive means.

Similarly, the stacker drive interface cog 11 is configured to operatively engage with a banknote validator second drive means (not shown) and transmit drive force via a further internal drive gear train (not shown) disposed within the housing 12 to a second stacker drive cog 13. Rotational drive is then transferred from the second stacker drive cog 13 to a banknote cashbox drive interface (not shown) to facilitate operation of the stacker mechanism 201 directly from the banknote validator 100.

The banknote transport module 5 also includes a pair of light sensor pipes 14 which are arranged so as to provide a circular light path for detection of the stacker mechanism position within the banknote cashbox 200.

Advantageously, the size and shape of the aperture 20 and the presence of the cashbox docking station 4, means that even when the banknote transport module 5 is fully removed from the safe conduit device 2 (see FIG. 6), access to the cashbox 200 is not possible.

The invention claimed is:

1. A safe conduit device comprising:

a banknote validator docking station adapted to be securely mounted to an outer surface of a safe wall of a safe, wherein the banknote validator docking station is configured to removably receive and securely engage with a banknote validator;

a banknote cashbox docking station adapted to be securely mounted to either an inner surface of the safe or to the banknote validator docking station such that the banknote cashbox docking station is spatially separated from said banknote validator docking station and is disposed within the safe, wherein the banknote cashbox docking station is configured to removably receive and securely engage with a banknote cashbox;

a banknote transport module defining a banknote transport path configured to enable the conveyance of a banknote between the banknote validator and the banknote cashbox through apertures in the cashbox docking station and the banknote validator docking station; and one or more support members extending from the inner surface of the safe wall into the interior of the safe, wherein the one or more support members are attached to the cashbox docking station and the one or more support members are shorter than the banknote transport module such that the cashbox docking station is secured at a fixed position within the safe and the banknote transport module interfaces with both the banknote validator docking station and the banknote cashbox docking station.

2. A safe conduit device as claimed in claim 1, wherein the one or more support members pass through the safe wall.

3. A safe conduit device as claimed in claim 1, wherein the safe wall delimits a boundary between the interior and the exterior of a safe to which the safe conduit device is attachable.

4. A safe conduit device as claimed in claim 3, wherein the spatial separation between the banknote validator docking station and the banknote cashbox docking station is greater than a width of the safe wall.

5. A safe conduit device as claimed in claim 1, wherein said banknote transport module is removable from said banknote validator docking station when the banknote validator is removed from said banknote validator docking station.

6. A safe conduit device as claimed in claim 1, wherein the spatial separation between the banknote validator docking station and the banknote cashbox docking station is greater than a width of the safe wall.

7. A safe conduit device according to claim 1, and further comprising:

a) a banknote validator configured to removably and lockably engage with the banknote validator docking station, and b) a banknote cashbox configured to removably and lockably engage with the banknote cashbox docking station.

8. A safe conduit device according to claim 1 wherein the banknote validator docking station defines an aperture that is in operative communication with the banknote transport module, and is effective to transport a banknote from the banknote validator to the banknote transport module.

9. A safe conduit device according to claim 1 wherein the banknote cashbox docking station is in operative communication with the banknote transport module, and is effective to transport a banknote from the banknote transport module to the banknote cashbox.

10. A safe conduit device as claimed in claim 1, wherein the one or more support members are anchored to an inner surface of the safe.

11. A safe conduit device comprising:

a) a banknote validator docking station adapted to be securely mounted to an outer surface of a safe wall of a safe, wherein the banknote validator docking station is configured to removably receive and lockably engage with a removable banknote validator, yet separate and distinct from said removable banknote validator;

b) a banknote cashbox docking station adapted to be securely mounted to either an inner surface of the safe or to the banknote validator docking station such that the banknote cashbox docking station is spatially separated from said banknote validator docking station and is disposed within the safe, wherein the banknote cashbox docking station defines a receiving aperture configured to removably receive and lockably engage with a removable banknote cashbox, yet separate and distinct from said removable banknote cashbox; and c) a banknote transport module having a cross-sectional profile and a proximal end, and configured to provide a removable bridge spanning the spatial separation between the banknote validator docking station and the banknote cashbox docking station, and providing a banknote transport path configured to enable the conveyance of a banknote between the banknote validator and the banknote cashbox, wherein the banknote validator docking station defines an aperture having a shape that mirrors and corresponds to the cross-sectional profile of the banknote transport module;

d) one or more support members extending from the inner surface of the safe wall into the interior of the safe, wherein the one or more support members are and the one or more support members are shorter than the banknote transport module and attached to the cashbox docking station such that the cashbox docking station is secured at a fixed position within the safe and the banknote transport module interfaces with both the banknote validator docking station and the banknote cashbox docking station.

12. A safe conduit device according to claim 11 wherein the size and shape of the banknote cashbox docking station and the banknote transport module are adapted such that even when the banknote transport module is fully removed from the safe conduit device, access to the banknote cashbox is not possible.

13. A safe conduit device according to claim 11 wherein the device further includes a removable banknote validator configured to lockably engage with the banknote validator docking station, and a removable banknote cashbox configured to lockably engage with the banknote cashbox docking station.

14. A safe conduit device according to claim 13 wherein the banknote validator docking station is adapted to functionally engage with the banknote validator and with the banknote transport module to permit the passage of a banknote from the banknote validator through the banknote validator docking station and subsequently into the banknote transport module, and wherein the banknote cashbox docking station is adapted to functionally engage with the banknote cashbox and with the banknote transport module to permit the passage of a banknote from the banknote transport module through the banknote cashbox docking station and subsequently into the banknote cashbox.

* * * * *